United States Patent [19]

Jacks

[11] 4,058,032

[45] Nov. 15, 1977

[54] OPEN-END WRENCH

[76] Inventor: Richard Benton Jacks, P.O. Box 284, Sunnyvale, Calif.

[21] Appl. No.: 705,690

[22] Filed: July 15, 1976

Related U.S. Application Data

[63] Continuation of Ser. No. 564,222, April 2, 1975, abandoned.

[51] Int. Cl.[2] ..... B25B 13/02
[52] U.S. Cl. ..... 81/125
[58] Field of Search ..... 81/125

[56] References Cited

U.S. PATENT DOCUMENTS

| | | | |
|---|---|---|---|
| 909,514 | 1/1909 | Atkins | 81/125 |
| 1,056,848 | 3/1913 | Starrett et al. | 81/125 UX |
| 2,800,822 | 7/1957 | Allred | 81/125 |
| 3,286,749 | 11/1966 | Learned | 81/125 X |

FOREIGN PATENT DOCUMENTS

| | | | |
|---|---|---|---|
| 107,741 | 6/1943 | Sweden | 81/125 |
| 230,545 | 4/1944 | Switzerland | 81/125 |

*Primary Examiner*—James L. Jones, Jr.
*Assistant Examiner*—James G. Smith
*Attorney, Agent, or Firm*—Flehr, Hohbach, Test, Albritton & Herbert

[57] ABSTRACT

An improved open-end wrench which will retain an appropriately sized nut in the U-shaped recess at either end of the wrench, thus preventing loss of the nut and freeing one hand for other activities. Resilient insert means such as a spring wire clip or equivalent means is slidably positioned within the jaws forming the U-shaped recess so as to protrude slightly into the recess on at least one side. Sliding movement of the resilient insert means permits the nut to be frictionally engaged and held within the U-shaped recess, during threading or unthreading of the nut or like conventional use of the open-end wrench.

2 Claims, 5 Drawing Figures

OPEN-END WRENCH

This is a continuation of application Ser. No. 564,222, filed Apr. 2, 1975, now abandoned.

BACKGROUND OF THE INVENTION

As is well known to industrial workers, particularly in the automotive and in aircraft trades, it is frequently necessary to start or remove nuts from studs and bolts which are located in relatively inaccessible positions. Common practice is for the worker to hold the wrench in one hand and to use the other hand to initially position the nut for threading, or to catch the nut after it is unthreaded. When working at an appreciable elevation, as with aircraft, the nut may be easily lost, particularly where the worker must use one hand for safety or balance. Also, the bolt or stud may be positioned between two closely adjacent parts so that it is difficult to place or remove the nut, under any circumstances. The annoyance of not being able to easily start a nut, or attending the accidental loss of a nut with the necessity of retrieval, is well known to even the casual user of tools of the type described.

Numerous efforts have been made to develop tools which simplify the task of starting or removing nuts from threaded members, such as studs and bolts. One commercial variation of an open-end wrench, for example, is provided with a box wrench at one end which may be offset for hand clearance. However, use of a box wrench attachment of the type described does not solve the problem of loss of nuts, since the box wrench must necessarily have an opening of sufficient internal diameter to pass easily over the nut. Also, such arrangement negates the possibility of jaws of differing width at either end of the wrench, as is customary with the standard open-end wrench.

More recently, nut holding attachments have been specifically devised for open-end wrenches, such devices being intended to hold the nut in place between the jaws of the wrench uring the starting of the nut. Such devices are disclosed for example in Malcolm U.S. Pat. No. 2,369,400 and Becker U.S. Pat. No. 2,557,628. However, such devices, which are placed externally of the wrench, have the disadvantage of being easily dislodged. They also present protrusions and projections which interfere with use of the wrench, and which cause the attachments to be discarded by the worker as generally useless for day to day operations. They also have the disadvantage of greatly increasing the cost of the wrench. A principal defect of such attachment means is their inability to effectively hold a nut within the jaws of a wrench so that the tool can be easily used for the intended purpose.

SUMMARY OF THE INVENTION

This invention relates generally to an improved open-end wrench, and more particularly to an open-end wrench having substantially integral means for holding a nut in place between the jaws of the wrench during starting (or removal) of nuts in positions of comparative inaccessibility.

In general, it is an object of the present invention to provide an improved open-end wrench which can be quickly, easily and firmly engaged upon a nut, for purposes of normal use, and just as easily disengaged from the nut.

It is a particular object of the invention to provide an improved open-end wrench wherein one or both ends of the wrench is provided with slidable resilient insert means for frictionally engaging a nut within the jaws of the wrench, whereby the position of the nut can be maintained and controlled throughout threading and unthreading operations of the nut carried out with only one hand.

A further object of the invention is to provide an improved open-end wrench for such purpose which has no substantial protruding parts and which to all outward purposes resembles a conventional open-end wrench.

A still further object of the invention is to provide an improved open-end wrench of such character which is relatively inexpensive and simple in construction, and which can be easily manufactured without any appreciable added expense.

As a brief statement of the invention, a nut-holding improvement has been made in a conventional open-end wrench of the type wherein an elongate handle terminates at either end in jaws forming a U-shaped recess to receive a nut. The improvement consists in the insertion of resilient means within a U-shaped opening of the jaws so as to protrude a slight distance into the U-shaped recess on at least one side. Bearing in mind that the jaws have a fixed width of opening, the resilient insert functions to frictionally engage at least one of the parallel sides of a multisided nut (e.g., hex nut, square nut, etc.) and thereby hold the nut within the opening between the jaws during operations of threading or unthreading the nut. The degree of frictional resistance is such that the nut can be easily inserted into a retained position, and just as easily removed, by movement of the wrench or by the pressure of the fingers. Such frictional resistance is achieved by a resiliency and slide mounting of the insert within the U-shaped recess of the wrench, so that the insert can be spread apart to grasp the nut during use, but will return to its original position thereafter. In general, for advantageous use, the force of the frictional engagement should be sufficient that the full weight of the wrench can be supported on the nut. In any event, the frictional resistance should be sufficient to retain the nut within the U-shaped opening against the force of gravity, so that a positive action is required to place or to remove the nut from the wrench opening.

Other features and advantages of the invention will be apparent from the following description taken in conjunction with the drawing.

DESCRIPTION OF THE PREFERRED EMBODIMENT

Figure 1:
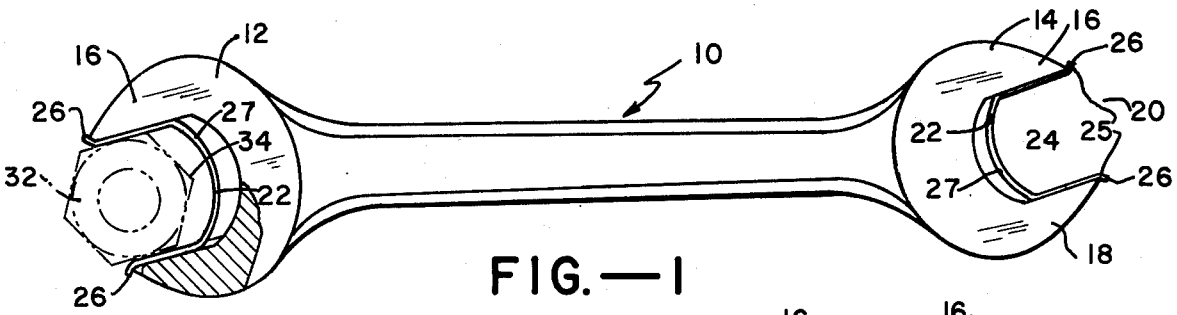
FIG. 1 is a side elevational view of an illustrative embodiment of an improved open-ended wrench embodying the present invention, and with parts broken away for clarity of illustration.
Figure 1A:
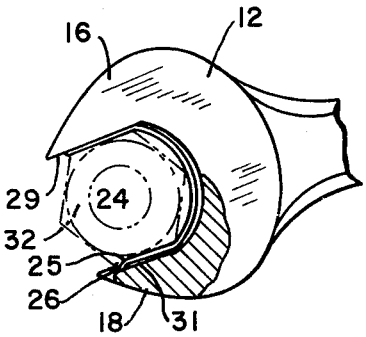
FIG. 1*a* is a like view, showing a nut in place in one end of the wrench.
Figure 2:
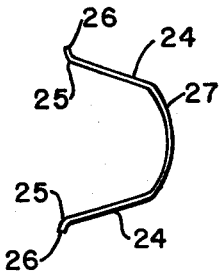
FIG. 2 is a side elevational view, illustrating resilient insert means as used in the embodiment of FIG. 1.
Figure 3:
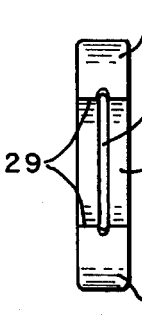
FIG. 3 is an end view of the embodiment of FIG. 1, with the resilient insert means removed.
Figure 4:
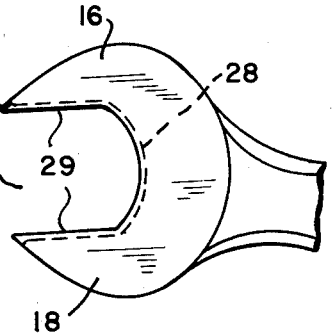
FIG. 4 is a side elevational view of the end of the wrench shown in FIG. 3, with portions shown in dotted outline.

Referring to FIGS. 1 to 4, reference numeral 10 generally represents a standard open-end wrench provided with nut receiving heads 12 and 14 at either end. Each of the heads is provided with opposed jaws 16 and 18 which are dimensioned to provide a generally U-shaped opening of a fixed width, depending upon size and intended use of the wrench. Conventionally, the head at one end is of a size to accommodate one size of nut whereas the head at the other end will accommodate a nut of slightly larger or smaller size (e.g., ¾ inch and 11/16 inch). In accordance with the present invention, the standard construction of the wrench is improved by the provision of resilient insert means at one or both ends of the wrench. As shown in FIG. 1, the resilient insert means is in the form of a generally U-shaped clip of spring wire 22. In one very satisfactory form of the invention, the insert 22 is formed as a substantially U-shaped length of spring steel (viz., music wire) wherein the side portions 24 and tip portions 26 are permanently deformed in an outward direction as respects the central portion 27 and the parallel sides 29 of the U-shaped opening 20. This construction permits the wire insert 22 to be frictionally engaged within a properly dimensioned groove 28 which is formed on the inside periphery of the opening 20, midway between the edges of the parallel sides or "jaws" of the wrench. The groove 28 is dimensioned so as to be sufficiently deep to receive the diameter of the spring wire 22 so that a portion of the wire will protrude a slight distance into the U-shaped opening or recess 20, on either side thereof (see FIG. 1, also FIG. 3), and to permit some vertical movement of the shank portions 24 of the wire in the groove (see lower portion 31 of groove 28 in FIG. 3, and enlarged detail of FIG. 7). Referring to FIGS. 1, 1*a* and 4, the outer ends of the recess 28 may be slightly beveled, as at 30, to receive the outwardly flaring tips 26 of the spring wire. This arrangement permits the wire to be inserted within the groove so that the tip portions 26 protrude slightly beyond the open end of the wrench, as indicated in FIG. 1.

Upon frictionally engaging a nut 32 within an opening 20 of the wrench (see left portion of FIG. 1), the sides of the nut will engage the shank portions 24 of the insert 22, whereas a forward point 34 of the nut will engage the inner loop 27 of the insert wire. As illustrated, the effect is to slidingly move the wire 22 slightly inward with respect to the opening 20 so that the shank portions 24 of the spring wire move inward to firmly engage and wedge the nut 32 between both the shank portions 24 and end portions 26. As particularly illustrated in FIG. 1*a*, the ends 26 become locked within the groove 28. At the same time, the shank portions 24 of the wire are pressed outward by the nut, into the space 31 provided in groove 28 for such outward or vertical movement. The net effect is that the nut 32 is firmly positioned and retained within the U-shaped opening 20, by the resiliency of the insert 22, where it will remain during all the operations to thread or unthread the nut on a bolt or stud. When it is desired to remove the wrench from the nut, all that is required is a brief separating movement of these parts, that is, by grasping and pulling the nut with the fingers or by moving the wrench outward with respect to the nut (e.g., as held in position on a bolt).

It will be appreciated that the spring wire 22 is easily and inexpensively fabricated and that existing open-end wrench constructions are likewise easily modified to receive the spring wire. By way of illustration, a rotary routing tool of desired dimension and hardness can be passed between the opposed jaws 16 and 18 to rout out the parallel side portions of the groove 28 and, at the end of the pass, the inner curved portion. Such operation is easily understood and well within the skills of the conventional tool maker.

With reference to both the dimensions of the groove 28 and the insert 22, and the material of construction of the latter, the relationship should be such that the extending side portions of the insert can be resiliently spread apart by the entering nut, for example, into the spaces 31 provided within the groove, while retaining sufficient frictional engagement with the nut to firmly hold the nut within the U-shaped recess 20. Thus, assuming use of a wire of spring steel, having a diameter within the range of 0.02 to 0.07 inch (0.05 to 0.18 mm), the width of the router employed to form the groove 28 can be of substantially equivalent dimension to the diameter of the wire. This will insure a firm frictional fit of the resilient insert 22 within the groove 28. The depth of the groove 28 may be equal to or just slightly less than the diameter of the wire, say 0.018 to 0.068 inch (0.045 to 0.17 mm), to thereby facilitate the outward movement of the wire into the space 31 at the bottom of the groove 28. On the other hand, the "spring" configuration of the wire can be such that only about ½ to ⅓ the diameter of the wire will normally be received within the groove and, conversely, about ½ to ⅓ of the diameter of the wire will protrude into the U-shaped recess 20.

As indicated, this particular relationship can be achieved by preselection of the dimensions of the spring wire or like insert 22 with respect to the excess space or depth 31 of the groove 28. It can also be achieved by a configuration of the insert to provide a certain amount of vertical play within the groove, for example, as provided by the bends 25 between the portions 24 and 26 of the wire insert.

From the foregoing, it will be evident that the present invention makes possible the modification of existing open-end wrenches to provide a very substantial improvement in the use of such tools. In particular, the improved open-end wrench of the present invention enables a worker to position a nut within the resilient insert means at the appropriate end of the wrench and to thereafter position the nut on the end of a bolt or stud, in a one-handed operation. Having thus started the nut, the wrench can be easily rotated in the most suitable fashion for the task at hand, and the worker will be assured throughout such operation that the nut will not fall from the wrench (or vice versa). When the nut has been tightened on the bolt, as desired, the wrench is easily disengaged by simple outward movement to disengage the wrench (i.e., to disengage the resilient insert means) from the nut. In like fashion, a nut can be easily removed from a bolt or stud in a reverse operation, with virtual elimination of accidental loss of the nut such as frequently occurs with conventional wrenches due to the necessary clearance provided between the jaws of the wrench and the nut. One-handed operations within relatively inaccessible spaces are thus facilitated, with no fear of accidental loss of the nut when it becomes free of the bolt. When the nut is loose from the bolt, it is easily removed from the wrench by simply pulling it out with the fingers. These and other advantages in the use of the wrench will be apparent to those skilled in this art, including, particularly, the freeing of one hand for balance or safety while the wrench is being employed in the other hand.

It will additionally be apparent that the improved open-end wrench of the present invention can be easily fabricated on existing manufacturing lines, with only very minor and inexpensive alterations in the manufacturing procedure, thus facilitating manufacture at a very small increase in cost, while providing all of the described advantages.

What is claimed is:

1. In an open-end wrench of the type wherein an elongate handle terminates at either end in jaws forming a U-shaped recess to receive a nut, the improvement comprising: groove means formed on the inside of said U-shaped recess, resilient insert means positioned within said groove means so as to protrude into said U-shaped recess, said resilient insert means being formed as a substantially U-shaped length of spring wire having an inner loop portion which entirely protrudes into said U-shaped recess and opposed shank portions which partially protrude into said U-shaped recess, such positioning of the spring wire within said groove means facilitating initial grasping and retention of a nut between said shank portions and subsequent inward locking movements of said spring wire with respect to both said groove means and said U-shaped recess in response to contact of the nut with said loop portion, said substantially U-shaped length of spring wire being additionally provided with outwardly flaring tip portions on said shank portions which protrude slightly beyond open ends of the groove means within said U-shaped recess, the diameter of said spring wire being slightly greater than the depth of said groove means so that outward expansion of said spring wire can be only partially accommodated within said groove means whereby a nut can be slidingly engaged within said U-shaped recess between said shank portions of the spring wire and thereafter with the loop portion of said spring wire to cause said outwardly flaring tip portions of the spring wire to slidably engage within said groove means to lock both the nut and the spring wire in place by compression.

2. An open-end wrench as in claim 1 wherein said substantially U-shaped length of spring wire is retained within said groove means, and said groove means is formed as a substantially continuous groove formed on the inside of said U-shaped recess, the depth of said groove being of the order of 0.002 inch less than the diameter of said spring wire so that upon outward expansion of the latter upon engagement with a nut only a part of the spring wire diameter will be accommodated within said groove.

* * * * *